US010149596B2

(12) United States Patent
Hederstierna et al.

(10) Patent No.: US 10,149,596 B2
(45) Date of Patent: Dec. 11, 2018

(54) CUTLERY TRAY MODULE FOR A DISHWASHER AND DISHWASHER COMPRISING AT LEAST ONE CUTLERY TRAY MODULE

(71) Applicant: ELECTROLUX HOME PRODUCTS CORPORATION N.V., Brussels (BE)

(72) Inventors: Rickard Hederstierna, Lund (SE); Daniel Mesa, Stockholm (SE); Pontus Kåberg, Sollentuna (SE)

(73) Assignee: Electrolux Home Products Corporation N.V., Brussels (BE)

( * ) Notice: Subject to any disclaimer, the term of this patent is extended or adjusted under 35 U.S.C. 154(b) by 371 days.

(21) Appl. No.: 14/653,178

(22) PCT Filed: Dec. 21, 2012

(86) PCT No.: PCT/EP2012/076761

§ 371 (c)(1),
(2) Date: Jun. 17, 2015

(87) PCT Pub. No.: WO2014/094894

PCT Pub. Date: Jun. 26, 2014

(65) Prior Publication Data

US 2015/0320290 A1 Nov. 12, 2015

(51) Int. Cl.
*A47L 15/50* (2006.01)

(52) U.S. Cl.
CPC ..... *A47L 15/502* (2013.01); *A47L 15/505* (2013.01)

(58) Field of Classification Search
CPC ..... A47L 15/502; A47L 15/505
(Continued)

(56) References Cited

U.S. PATENT DOCUMENTS 1,484,291 A * 2/1924 Blakeslee ..... A47L 19/04 211/41.3
1,691,858 A 11/1928 Ryerson
(Continued)

FOREIGN PATENT DOCUMENTS

CN 1610515 4/2005
CN 2889155 4/2007
(Continued)

OTHER PUBLICATIONS

International Search Report for PCT/EP2012/076755; dated Feb. 27, 2013.

(Continued)

*Primary Examiner* — Brent W Herring
(74) *Attorney, Agent, or Firm* — Alston & Bird LLP

(57) ABSTRACT

The present invention relates to a cutlery tray module (1) for a dishwasher, said cutlery tray module (1) comprising a bottom surface (2), adapted for substantially horizontal reception of cutlery items. The bottom surface (2) comprising a plurality of cutlery holding elements (3), adapted to hold said cutlery items, and at least one elongated indentation (4), having a longitudinal extension in a direction D. At least a number of said cutlery holding elements (3) are arranged such that said cutlery holding elements (3) are adapted to hold said cutlery items essentially transversely, with respect to said direction D, and across said elongated indentation (4). The present invention further relates to a dishwasher comprising at least one cutlery tray module (1).

18 Claims, 3 Drawing Sheets

(58) Field of Classification Search
USPC ..... 211/41.8, 41.9, 41.3, 41.4, 41.7
See application file for complete search history.

(56) References Cited

U.S. PATENT DOCUMENTS 1,714,266 A 5/1929 Ernest
2,600,096 A 6/1952 Cooper et al.
3,568,848 A * 3/1971 Tzifkansky ..... A47L 15/501 211/41.8
3,887,102 A 6/1975 Earley
3,935,958 A 2/1976 Frangos
4,046,261 A 9/1977 Yake
4,372,448 A 2/1983 Drach
4,564,118 A 1/1986 Heyer et al.
5,016,772 A 5/1991 Wilk
5,083,827 A 1/1992 Hollenbaugh, Sr.
5,086,544 A 2/1992 Huttemann
5,431,294 A 6/1995 Stottmann et al.
5,462,348 A 10/1995 Ellingson et al.
5,601,195 A 2/1997 Finola et al.
5,626,242 A * 5/1997 Weizer ..... A47L 15/50 211/151
5,881,906 A 3/1999 Rogers et al.
6,125,548 A 10/2000 Dunn et al.
6,467,622 B1 10/2002 Hull
6,848,585 B2 2/2005 VanLandingham
6,945,421 B2 9/2005 Phifer
7,231,929 B2 6/2007 Landsiedel et al.
7,445,128 B2 11/2008 Kaczmarek
7,455,066 B2 * 11/2008 Feddema ..... A47L 15/502 134/56 D
7,458,473 B1 12/2008 Mason
7,464,827 B2 12/2008 Meissen
7,478,642 B2 1/2009 Koch et al.
7,493,905 B2 2/2009 Jeong et al.
7,862,664 B2 1/2011 Choi et al.
7,931,155 B2 4/2011 Bastuji
8,163,103 B2 4/2012 Shin et al.
RE43,349 E 5/2012 Dunn et al.
8,191,560 B2 * 6/2012 Mallory ..... A47L 15/503 134/145
8,196,593 B2 6/2012 Schessl et al.
8,303,725 B2 11/2012 Crookshanks et al.
8,353,412 B2 1/2013 Rosenbauer et al.
8,356,719 B2 1/2013 Haltmayer et al.
D683,504 S * 5/2013 Clores ..... D32/3
8,522,998 B2 9/2013 Crookshanks et al.
8,540,085 B2 * 9/2013 Klump ..... A47L 15/50 134/135
8,646,620 B2 2/2014 Klump et al.
8,651,287 B2 2/2014 Moser et al.
8,746,467 B2 6/2014 Jeong
8,794,455 B2 8/2014 Yang et al.
8,858,725 B2 10/2014 Mailander
D725,325 S * 3/2015 Lee ..... D32/3
D725,851 S * 3/2015 Lee ..... D32/3
9,107,552 B2 8/2015 Micek et al.
9,119,493 B2 * 9/2015 Jeong ..... A47L 15/502
9,119,524 B2 * 9/2015 Renz ..... A47L 15/503
9,161,677 B2 * 10/2015 Hofpeter ..... A47L 15/502
9,186,038 B2 * 11/2015 Bastuji ..... A47L 15/502
2003/0089672 A1 5/2003 VanLandingham
2004/0079713 A1 4/2004 Wendt et al.
2005/0109378 A1 5/2005 Landsiedel et al.
2005/0167374 A1 8/2005 Yang et al.
2005/0178412 A1 8/2005 Koch et al.
2005/0241682 A1 11/2005 Jeong et al.
2006/0113260 A1 6/2006 Purushothaman et al.
2006/0219271 A1 * 10/2006 Feddema ..... A47L 15/502 134/56 D
2006/0243681 A1 11/2006 Bastuji et al.
2006/0250058 A1 * 11/2006 Stevens ..... A47L 15/502 312/311
2007/0039636 A1 2/2007 Egger et al.
2007/0039904 A1 2/2007 Purushothaman
2007/0090063 A1 4/2007 Schmidt
2007/0119801 A1 5/2007 Miele et al.
2008/0072937 A1 3/2008 Choi et al.
2008/0110480 A1 5/2008 Choi et al.
2008/0156358 A1 7/2008 Shin et al.
2008/0156362 A1 7/2008 Shin et al.
2008/0169009 A1 7/2008 Mailander
2008/0302740 A1 12/2008 Moser et al.
2009/0038657 A1 * 2/2009 Kang ..... A47L 15/502 134/137
2009/0140619 A1 6/2009 Buehlmeyer et al.
2009/0211994 A1 8/2009 Yang et al.
2010/0051069 A1 3/2010 Schessl et al.
2010/0117498 A1 5/2010 Leinmuller et al.
2010/0155280 A1 * 6/2010 Graute ..... A47L 15/502 206/372
2010/0314977 A1 * 12/2010 Mallory ..... A47L 15/504 312/228.1
2011/0018410 A1 1/2011 Bastuji et al.
2011/0193457 A1 8/2011 Bastuji
2011/0247990 A1 10/2011 Chai
2011/0253650 A1 10/2011 Renz et al.
2012/0139400 A1 6/2012 Hofpeter et al.
2012/0181242 A1 7/2012 Jeong
2012/0292269 A1 * 11/2012 Klump ..... A47L 15/50 211/41.8
2013/0002107 A1 * 1/2013 Paschini ..... A47L 15/502 312/228.1
2013/0319172 A1 12/2013 Uhl
2014/0190528 A1 * 7/2014 Wegener ..... A47L 15/502 134/92
2014/0239784 A1 * 8/2014 Jeong ..... A47L 15/502 312/228.1
2014/0263111 A1 9/2014 Micek et al.
2015/0182104 A1 * 7/2015 Jeong ..... A47L 15/505 134/92
2015/0196189 A1 * 7/2015 Shaffer ..... A47L 15/502 312/228.1
2015/0245761 A1 * 9/2015 Zhou ..... A47L 15/502 211/70.7
2015/0327749 A1 * 11/2015 Kaberg ..... A47L 15/502 211/41.9
2015/0335225 A1 * 11/2015 Seu ..... A47L 15/502 211/41.9

FOREIGN PATENT DOCUMENTS

CN 101563016 A 10/2009
CN 101917894 12/2010
DE 1 917 909 U 6/1965
DE 7008981 U 7/1970
DE 7032937 U 12/1970
DE 2 701 879 7/1978
DE 3 534 897 4/1987
DE 43 09 915 A1 9/1994
DE 195 40 611 A1 5/1997
DE 299 01 901 U1 6/2000
DE 10 353 725 6/2005
DE 10 2008 062761 3/2010
DE 102008062761 * 3/2010 ..... A47L 15/502
DE 10 2010 042 409 4/2012
DE 10 2011 081 774 2/2013
EP 0 186 157 7/1986
EP 1 072 221 A1 1/2001
EP 1275336 1/2003
EP 1854395 A1 * 11/2007 ..... A47L 15/502
EP 2 272 416 1/2011
EP 2 377 455 10/2011
EP 2 478 820 7/2012
EP 2 554 097 2/2013
EP 2865316 A1 * 4/2015 ..... A47L 15/50
ES 2 168 937 A1 6/2002
FR 2643809 A1 * 9/1990 ..... A47L 15/502
GB 2 042 147 A 9/1980
GB 2419083 4/2006
JP 59 174154 11/1984
JP S62-61673 U 4/1987
JP 63 095573 6/1988

(56) References Cited

FOREIGN PATENT DOCUMENTS

| | | | |
|---|---|---|---|
| JP | 64 028259 | | 2/1989 |
| JP | 10-328117 | A | 12/1998 |
| JP | 2002345578 | | 12/2003 |
| WO | WO 2003/055375 | A1 | 7/2003 |
| WO | WO 2003/055376 | A1 | 7/2003 |
| WO | WO 2004/000090 | A1 | 12/2003 |
| WO | WO 2005/037051 | A1 | 4/2005 |
| WO | WO 2005/041744 | A1 | 5/2005 |
| WO | WO 2006/056515 AI | | 6/2006 |
| WO | WO 2008/035866 | A1 | 3/2008 |
| WO | WO 2008/061869 | A1 | 5/2008 |

OTHER PUBLICATIONS

International Search Report for PCT/EP2012/076761; dated Sep. 3, 2013.
European Search Report for Application No. EP 09 01 1294 dated Feb. 3, 2010.
European Search Report for Application No. EP 10 00 2618 dated Jul. 19, 2010.
International Search Report and Written Opinion for International Application No. PCT/EP2010/005252, dated Dec. 14, 2010.
International Search Report for Application No. PCT/EP2011/001202, dated Jan. 25, 2012.
Written Opinion for Application No. PCT/EP2011/001202, dated Jan. 25, 2012.
Written Opinion for Application No. PCT/EP2012/076755, dated Feb. 27, 2013.
Written Opinion for Application No. PCT/EP2012/076761, dated Sep. 3, 2013.
Letter received from Louis Pohlau Lohrentz regarding Opposition against EP 2 364 636 B1 of Electrolux Home Products Corporation; VII. Indication of Facts and Evidence as to Grounds on Which the Opposition is Based Pursuant to Rule 75(2)(c) EPC, dated Mar. 19, 2014, 14 pages.
Notice of Opposition to a European Patent (EP 2364636) dated Mar. 29, 2014, 5 pages.
Office Action for European Application No. EP 09 011 294.7 dated Feb. 1, 2013.
Notice of Allowance for U.S. Appl. No. 13/583,762 dated Apr. 11, 2016.
Letter from Louis Pohlau Lohrentz regarding Opposition Against EP 2 364 636 B1 of Electrolux Home Products Corp. N.V. in response to Patentees Letter of Aug. 26, 2013 introducing documents (dated Mar. 23, 2016).
Statement Regarding the Opposition of European Patent No. 2364636 w/Appendix dated May 12, 2016 for U.S. Appl. No. 13/583,762.
Rule 71(3) Communication of Intent to Grant Patent for corresponding European Patent Application No. 12 815 702.1 dated Sep. 6, 2016, 7 pages.
Office Action for U.S. Appl. No. 14/653,181 dated Aug. 15, 2016.
Intention to Grant European Application No. 12 815 702.1 dated Sep. 6, 2016.
Notice of Appeal and Opposition Document Records for EP 3364636 dated Jun. 20, 2016 through Aug. 23, 2016.
Office Action for Chinese. Application No. 201280077769.2 dated Dec. 23, 2016.
Office Action for U.S. Appl. No. 14/653,181 dated Feb. 3, 2017.
Office Action for Chinese Application No. 201280077772.4 dated Feb. 22, 2017.

* cited by examiner

CUTLERY TRAY MODULE FOR A DISHWASHER AND DISHWASHER COMPRISING AT LEAST ONE CUTLERY TRAY MODULE

CROSS-REFERENCE TO RELATED APPLICATION

This application is a national stage entry of PCT/EP2012/076761 filed Dec. 21, 2012, which application is incorporated by reference herein in its entirety.

FIELD OF THE INVENTION

The present invention relates to a cutlery tray module for a dishwasher and a dishwasher comprising at least one cutlery tray module according to the preambles of the independent claims.

BACKGROUND OF THE INVENTION

Dishwashers, and in particular dishwashers designed for domestic use, are often provided with a cutlery basket or a cutlery tray for stacking cutlery pieces. Most commonly, cutlery baskets are detachably arranged within the lower rack of the dishwasher, and arranged for essentially vertical reception of cutlery. Cutlery trays are arranged for substantially horizontal reception of cutlery, and are adapted to be extractably arranged in the dishwasher, e.g. in the upper part of the dishwasher, above the upper rack.

An example of a cutlery tray is disclosed in US 2010155280 A which shows a cutlery tray for a dishwasher including a frame extendably disposed in a washing tub, and a plurality of inserts movably disposed on the frame and adapted to hold dishware. The plurality of inserts includes a first horizontally displaceable insert and at least one vertically displaceable insert. A central insert is mounted between the two lateral inserts. The central insert, just as the lateral inserts, is designed as a plastic mesh insert having wires embedded therein by injection molding, and has a trapezoidal indentation allowing larger cutlery items (serving ladles, etc.) to be received therein.

In US 2010117498 A a cutlery drawer for dishwashers comprising a base section and a holding device for holding a cutlery items, is disclosed. The holding device includes two fastening sections that fastens the holding device to the base section and a center section that connects the two fastening sections to each other. The two fastening sections are configured to hold an item of cutlery on both sides of the item.

EP 0186157 A discloses a domestic dishwasher with a removable crockery basket and a separate cutlery basket in which items of cutlery can be placed for the purpose of washing. The cutlery basket provides cutlery slots in the form of cutlery holders and cutlery rests for individual items or cutlery placed separately and lengthwise alongside one another in the slots.

Thus, a variety of cutlery trays for stacking cutlery pieces have been suggested. However, the inventors of the present invention have identified a need for a cutlery tray, which provides quick and easy unloading of the cutlery items, and which provides improved cleaning of the cutlery items.

An object of the present invention is to provide a cutlery tray which facilitates unloading, of the cutlery items from the cutlery tray.

A further object of the present invention is to provide a cutlery tray with a user friendly surface.

Another object of the present invention is to provide a cutlery tray which provides thoroughly cleaning of the cutlery items in the dishwasher.

SUMMARY OF THE INVENTION

The above-mentioned objects are achieved by the present invention according to the independent claims.

Preferred embodiments are set forth in the dependent claims.

The cutlery tray module for a dishwasher, in accordance with the present invention comprises a bottom surface, adapted for substantially horizontal reception of cutlery items, said bottom surface comprising a plurality of cutlery holding elements, adapted to hold said cutlery items, and at least one elongated indentation, having a longitudinal extension in a direction D, wherein at least a number of said cutlery holding elements are arranged such that said cutlery holding elements are adapted to hold said cutlery items essentially transversely, with respect to said direction D, and across said elongated indentation.

In another aspect, the present invention relates to a dishwasher comprising at least one cutlery tray module.

SHORT DESCRIPTION OF THE APPENDED DRAWINGS

DETAILED DESCRIPTION OF PREFERRED EMBODIMENTS OF THE INVENTION

Figure 1:
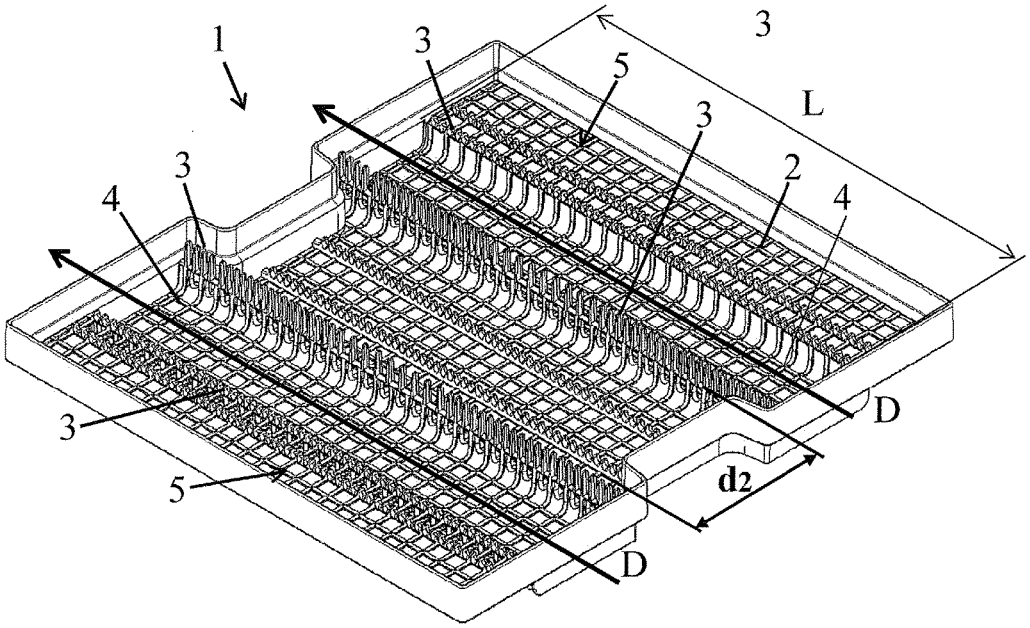
FIG. 1 shows a cutlery tray module, according to one embodiment of the present invention.

FIG. 1 shows the cutlery tray module 1 for a dishwasher, according to one embodiment of the present invention. The cutlery tray module 1 comprises a bottom surface 2, adapted for substantially horizontal reception of cutlery items (not shown). The bottom surface 2 comprises a plurality of cutlery holding elements 3, adapted to hold the cutlery items. The bottom surface 2 further comprises at least one elongated indentation 4, having a longitudinal extension in a direction D, wherein at least a number of the cutlery holding elements 3 are arranged such that the cutlery holding elements 3 are adapted to hold the cutlery items transversely, with respect to the direction D, and across the elongated indentation 4. The cutlery items being arranged essentially transversely with respect to said direction D and across the indentation 4 is advantageous in that a space is provided, between the bottom surface 2 and the cutlery items, which facilitates gripping the cutlery items and provides easy unloading of the cutlery items. The number of cutlery holding elements 3 may be approximately between 1-40 along one side of the indentation 4. Thus, between 1-40 cutlery items may be arranged along one indentation 4.

As can be seen in FIG. 1, the cutlery holding elements 3 are arranged along said indentations 4. The cutlery holding elements 3 are consecutively arranged essentially in the direction D. There may be a plurality of parallel rows of cutlery holding elements 3 arranged at each side of said indentation 4.

According to the embodiment shown in FIG. 1, the cutlery tray module 1 comprises a plurality of elongated indentations 4. In this case the number of indentations 4, being adapted to hold cutlery items transversely and across the indentation 4, are two. In the embodiment shown in FIG. 1, the indentations 4 are arranged at a distance $d_2$from each other. Arranging the indentations 4 at a distance $d_2$from each other ensures that there is sufficient space for the cutlery items. However, the number of indentations 4 may be any number, but preferably the number of indentations 4 is between 1-10.

As illustrated in FIG. 1, each one of the elongated indentations 4 has a length L, along the direction D, wherein the length L preferably is between 420-440 mm. However, the elongated indentations 4 may have other lengths L. In case of a plurality of indentations 4, the length L of the different indentations 4 may be different.

According to one embodiment, as shown in FIG. 1, the bottom surface 2 comprises at least a first supporting area 5, adapted to support the cutlery items, said supporting area 5 extending in the direction D along the indentation(s) 4. The first supporting area 5 is elevated with respect to the indentation 4. In one embodiment, as illustrated in FIG. 1, the number of cutlery holding elements 3 is arranged along said first supporting area 5.

Figure 2:
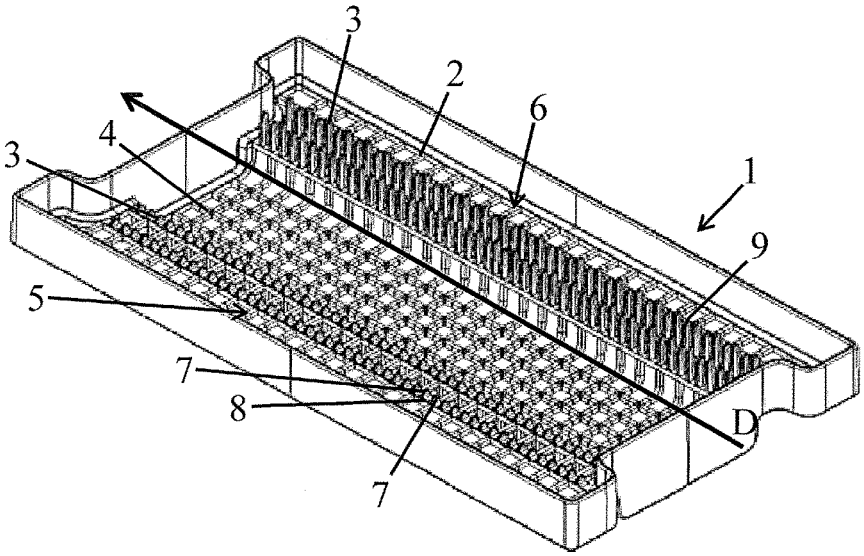
FIG. 2 shows the cutlery tray module, according to another embodiment of the present invention.

According to the embodiment shown in FIG. 2, the bottom surface 2 is essentially smooth, or at least partly essentially smooth, in the area of the indentation(s) 4. The term essentially smooth means that there are no holding elements 3 or other spiky or sharp elements provided on the bottom surface 2 in the area, or parts of the area, such that a user may load or unload cutlery items easily and without risking to be hurt when loading or unloading the cutlery items. Thus, the bottom surface 2 being smooth provides for a user friendly surface, which facilitates unloading of the cutlery items.

According to another embodiment, as shown in FIG. 2, the bottom surface 2 comprises a second supporting area 6. The number of cutlery holding elements 3 is then arranged, along the first supporting area 5 and the second supporting area 6. The first and second supporting areas 5, 6 are elevated with respect to the indentation 4, such that a space is provided between the cutlery items and the bottom surface 2 of the cutlery tray module 1. The first supporting area 5 is arranged along the opposite side of the indentation 4 with respect to the second supporting area 6.

In one embodiment, at least a number of the cutlery holding elements 3 are shaped as tines 9. The tines 9 are arranged along at least one of the first and second supporting areas 5, 6. In FIG. 2, two parallel rows of cutlery holding elements 3 shapes as tines 9 are arranged along the second supporting area 6.

According to one embodiment, as illustrated in FIG. 2, at least a number of the cutlery holding elements 3 comprises a plurality of protrusions 7 and intermediate recesses 8, the recesses 8 being adapted to receive a handle of one of the cutlery items. As can be seen in FIG. 2, the cutlery holding elements 3 comprising protrusions 7 and intermediate recesses 8 are arranged along the first supporting area 5. A recess 8 is provided between two consecutively arranged protrusions 7. In use, the handle of a cutlery item is arranged in said recess 8, and advantageously the handle is then kept in a desired position transversely with respect to said direction D, and across the indentation 4. Advantageously, the cutlery holding elements 3 provides good fixation of the cutlery items. The cutlery items are preferably arranged essentially 180° rotated with respect to said direction D. However, the cutlery items may be arranged in any other angle with respect to said direction D as long as the cutlery items extend across the indentation 4.

Figure 3:
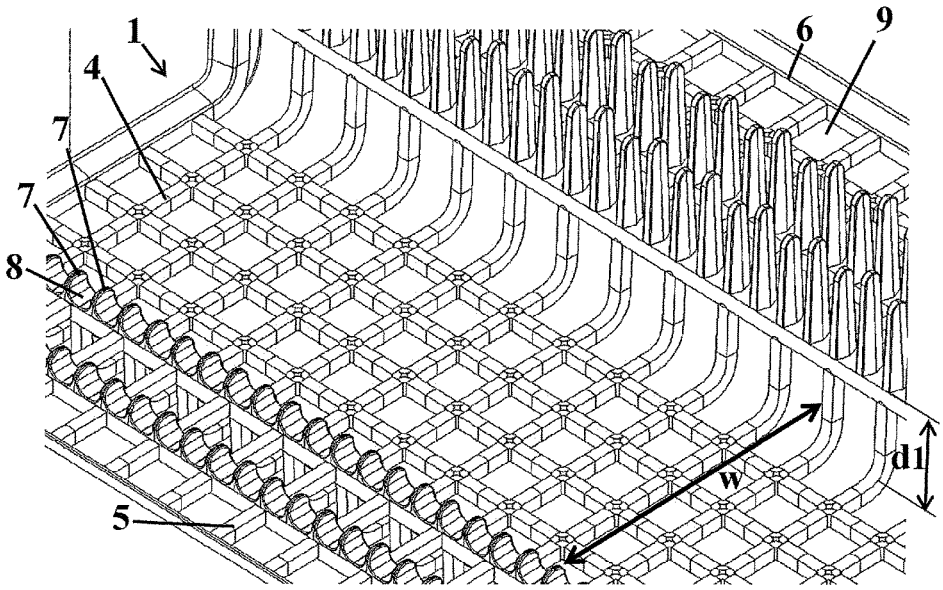
FIG. 3 shows a detail of the cutlery tray module illustrating the bottom surface comprising the cutlery holding elements, according to one embodiment of the present invention.

FIG. 3 shows a detail of the cutlery tray module 1 illustrating the bottom surface 2 comprising the cutlery holding elements 3. As illustrated in FIG. 3, the indentation 4 has a depth $d_1$, and the depth $d_1$ is approximately between 18-20 mm. Furthermore, the elongated indentation 4 has a width w, and the width w is approximately between 80-90 mm. In case of a plurality of indentations 4, the depth $d_1$ and the width w may be different at the different indentations 4.

According to one embodiment, the cutlery tray module 1 is adapted to be slidingly arranged within the dishwasher. Preferably, the cutlery tray module 1 is provided with sliding means along two opposite side edges.

In one embodiment, the cutlery tray module 1 is adapted to be adjacently arranged with at least one further cutlery tray module 1 in the dishwasher.

Figure 4:
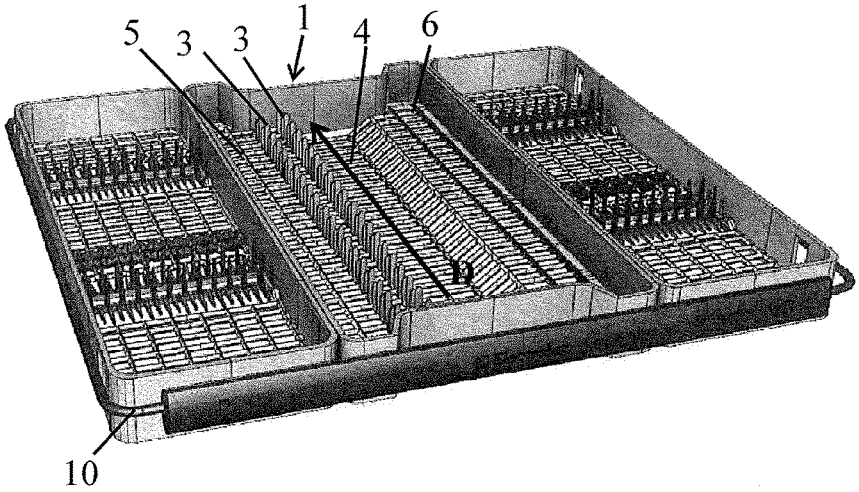
FIG. 4 shows one cutlery tray module arranged in a rack support, according to one embodiment of the present invention.

In another aspect, as illustrated in FIG. 4, the present invention relates to a dishwasher (not shown) comprising at least one cutlery tray module 1, the cutlery tray module 1 being arranged in a rack support 10 extractably arranged in the dishwasher. The rack support may be a wire support, or any other similar support, e.g. a rack support made of plastic. A plurality of cutlery tray modules 1 may then be detachably and rearrangeably arranged in the rack support 10 within the dishwasher.

In the embodiment shown in FIG. 4, the rack support 10 comprises three different modules, whereof the middle one is a cutlery tray module 1 according to the present invention. Naturally, all modules arranged in the rack support 10 may be cutlery tray modules 1 according to the present invention. In FIG. 4, the indentation 4 has a trapezoidal cross-section in the direction D. However, the indentations 4 may have other cross-sectional shapes, e.g. a square-shaped cross-section. Adjacently arranged cutlery tray modules 1 may be height-adjustably attached to each other. Advantageously, the removable cutlery tray modules 1 give the user the freedom to customize the product depending on their usability habits.

Figure 5:
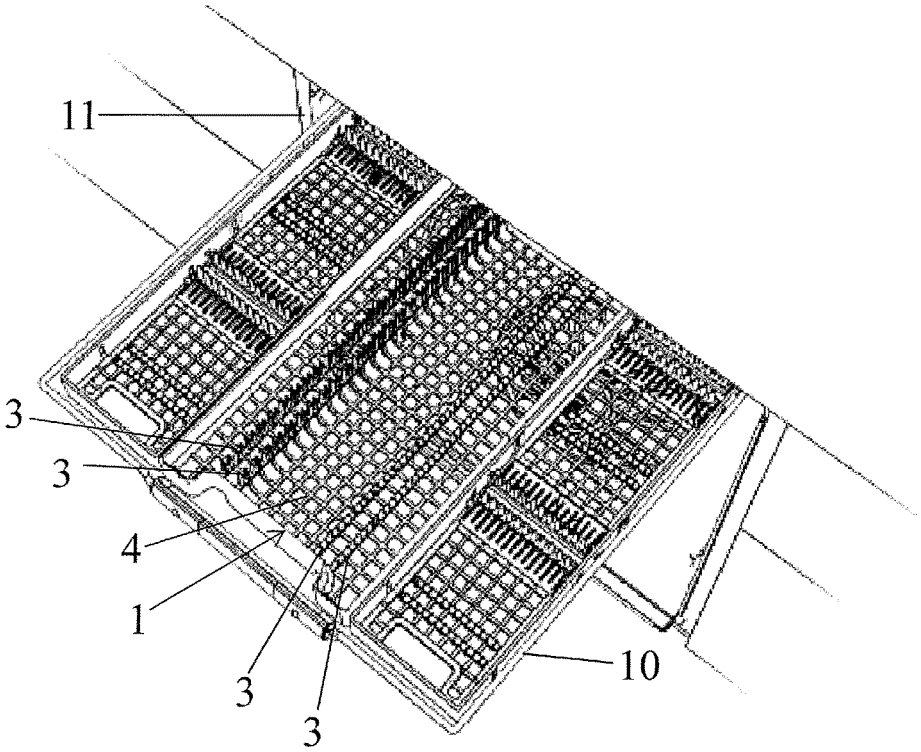
FIG. 5 shows a dishwasher comprising a cutlery tray module according to the present invention, arranged in a rack support, according to one embodiment of the present invention.

FIG. 5 shows a dishwasher 11 comprising one cutlery tray module 1 provided with an indentation 4 and a plurality of cutlery holding elements 3. The cutlery tray module 1 is arranged in a rack support 10 extractably arranged in the dishwasher 11.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A cutlery tray module for a dishwasher, said cutlery tray module comprising a bottom surface, adapted for substantially horizontal reception of cutlery items, said bottom surface comprising:

a plurality of cutlery holding elements, adapted to hold said cutlery items, at least one elongated indentation, having a longitudinal extension in a direction (D), wherein the at least one elongated indentation comprises an essentially smooth area, and a first supporting area adjacent the elongated indentation, and a second supporting area adjacent the elongated indentation, the second supporting area opposing the first supporting area on an opposite side of the elongated indentation relative to a width of the elongated indentation, wherein the at least one indentations comprises a first side wall extending from the first supporting area to the essentially smooth area of the at least one elongated indentation, and a second side wall extending from the second supporting area to the essentially smooth area of the at least one elongated indentation, wherein at least a number of said cutlery holding elements are arranged such that said cutlery holding elements are adapted to hold said cutlery items essentially transversely, with respect to said direction (D), and across said elongated indentation between the first supporting area and the second supporting area, wherein each of the first supporting area and the second supporting area includes at least one of the cutlery holding elements, and wherein the first supporting area and the second supporting area are fixedly and permanently connected to the elongated indentation in an elevated position relative to the essentially smooth area of the at least one elongated indentation to define a single, contiguous piece of the bottom surface.

2. The cutlery tray module according to claim 1, wherein said cutlery tray module comprises a plurality of elongated indentations.

3. The cutlery tray module according to claim 1, wherein said number of cutlery holding elements are arranged along said indentation.

4. The cutlery tray module according to claim 1, wherein the first supporting area and the second supporting area extend in said direction (D), along said indentation.

5. The cutlery tray module according to claim 4, wherein said number of cutlery holding elements is arranged along at least one of the first supporting area and the second supporting area.

6. The cutlery tray module according to claim 4, wherein said number of cutlery holding elements are arranged, along said first supporting area and said second supporting area.

7. The cutlery tray module according to claim 1, wherein said cutlery holding elements are consecutively arranged essentially in said direction (D).

8. The cutlery tray module according to claim 1, wherein said bottom surface is essentially smooth, or at least partly essentially smooth, in the area of said indentation.

9. The cutlery tray module according to claim 1, wherein at least a number of said cutlery holding elements are shaped as tines.

10. The cutlery tray module according to claim 1, wherein at least a number of said cutlery holding elements comprises a plurality of protrusions and intermediate recesses, said recesses being adapted to receive a handle of one of said cutlery items.

11. The cutlery tray module according to claim 10, wherein the protrusions define a curved cross section when viewed in the transverse direction, such that the intermediate recesses include a partially circular cross section when viewed in the transverse direction, such that the recess is configured to receive a handle of at least one of the cutlery items in the transverse direction.

12. The cutlery tray module according to claim 1, wherein said indentation has a depth ($d_1$), and wherein said depth ($d_1$) is approximately between 18-20 mm.

13. The cutlery tray module according to claim 1, wherein said elongated indentation has a length L, along said direction (D), wherein said length L is between 420-440 mm.

14. The cutlery tray module according to claim 1, wherein said elongated indentation has a width (w), and wherein said width w is approximately between 80-90 mm.

15. The cutlery tray module according to claim 1, wherein said cutlery tray module is adapted to be slidingly arranged within said dishwasher.

16. Dishwasher comprising at least one cutlery tray module according to claim 1, said at least one cutlery tray module being arranged in a rack support extractably arranged in said dishwasher.

17. A cutlery tray module for a dishwasher, said cutlery tray module comprising a bottom surface, adapted for substantially horizontal reception of cutlery items, said bottom surface comprising:

a plurality of cutlery holding elements, adapted to hold said cutlery items, at least one elongated indentation, having a longitudinal extension in a direction (D), and a first supporting area adjacent the elongated indentation, and a second supporting area adjacent the elongated indentation, the second supporting area opposing the first supporting area on an opposite side of the elongated indentation relative to a width of the elongated indentation, wherein at least a number of said cutlery holding elements are arranged such that said cutlery holding elements are adapted to hold said cutlery items essentially transversely, with respect to said direction (D), and across said elongated indentation between the first supporting area and the second supporting area, wherein each of the first supporting area and the second supporting area includes at least one of the cutlery holding elements, wherein the first supporting area and the second supporting area are fixedly and permanently connected to the elongated indentation in an elevated position relative to the elongated indentation to define a single, contiguous piece of the bottom surface, and wherein the elevated position of the first supporting area and the second supporting area is configured to define a space between a portion of the bottom surface in the at least one elongated indentation and the cutlery items, such that the cutlery items are configured to be gripped by a user between the portion of the bottom surface and the cutlery items.

18. The cutlery tray module according to claim 17, wherein said indentation has a depth ($d_1$), and wherein said depth ($d_1$) is approximately between 18-20 mm.

* * * * *